US006162778A

United States Patent [19]

McKillop et al.

[11] Patent Number: 6,162,778

[45] Date of Patent: Dec. 19, 2000

[54] LIGHT-DUTY LIQUID OR GEL DISHWASHING DETERGENT COMPOSITIONS HAVING BENEFICIAL SKIN CONDITIONING, SKIN FEEL AND RINSABILITY AESTHETICS

[75] Inventors: Kirsten Louise McKillop; Peter Robert Foley, both of Cincinnati, Ohio; Paul Jerome Crabtree, Kobe, Japan; James C. T. R. Burckett-St. Laurent, Cincinnati, Ohio; Joanna Margaret Clarke; Suchareeta Patil, both of Brussels, Belgium

[73] Assignee: The Procter & Gamble Company, Cincinnati, Ohio

[21] Appl. No.: 09/101,215

[22] PCT Filed: Dec. 17, 1996

[86] PCT No.: PCT/US96/20168

§ 371 Date: Jul. 2, 1998

§ 102(e) Date: Jul. 2, 1998

[87] PCT Pub. No.: WO97/25397

PCT Pub. Date: Jul. 17, 1997

Related U.S. Application Data

[60] Provisional application No. 60/009,994, Jan. 5, 1996.

[51] Int. Cl.[7] ..... C11D 3/34; B08B 3/00

[52] U.S. Cl. ..... 510/235; 510/392; 134/25.2

[58] Field of Search ..... 510/235, 236, 510/237; 134/25.2

[56] References Cited

U.S. PATENT DOCUMENTS

| | | | |
|---|---|---|---|
| 4,537,707 | 8/1985 | Severson, Jr. | 252/545 |
| 5,223,179 | 6/1993 | Connor et al. | 252/548 |
| 5,599,400 | 2/1997 | Mao et al. | 134/25.2 |
| 5,736,503 | 4/1998 | Vinson | 510/481 |

FOREIGN PATENT DOCUMENTS

| | | | |
|---|---|---|---|
| 2049097 | 2/1992 | Canada | C11D 3/386 |
| 0 125 854 | 11/1984 | European Pat. Off. . | |
| WO 95/06108 | 3/1995 | WIPO . | |
| WO 95/07971 | 3/1995 | WIPO | C11D 3/386 |
| WO95/30734 | 11/1995 | WIPO . | |

*Primary Examiner*—William Krynski
*Assistant Examiner*—Dawn L. Garrett
*Attorney, Agent, or Firm*—Donald E. Hasse; Brian M. Bolam; George W. Allen

[57] ABSTRACT

Liquid and gel dishwashing detergent compositions which exhibit good cleaning performance and desirable skin feel and rinsability aesthetics are disclosed. Such compositions comprise detergent surfactants, a nonionic surfactant- and hydrotrope-containing skin feel/rinsability enhancing system and small amounts of selected skin conditioning protease enzymes. Such compositions additionally will preferably contain suds boosters and divalent metal cations.

13 Claims, No Drawings

LIGHT-DUTY LIQUID OR GEL DISHWASHING DETERGENT COMPOSITIONS HAVING BENEFICIAL SKIN CONDITIONING, SKIN FEEL AND RINSABILITY AESTHETICS

This application claims benefit to provisional application 60/009,994 filed Jan. 5, 1996.

TECHNICAL FIELD

The present invention relates to liquid or gel dishwashing detergent compositions containing detergent surfactants, a skin feel and rinsability enhancement system and low levels of protease enzyme skin conditioning agents to impart consumer preferred skin conditioning, skin feel and rinsability characteristics to such dishwashing detergent products.

BACKGROUND OF THE INVENTION

Light-duty liquid or gel detergent compositions useful for manual dishwashing operations are well known in the art. Such products are generally formulated to provide a number of widely diverse performance properties and characteristics. First and foremost, liquid or gel dishwashing products must be formulated with enough surfactants and other cleaning adjuvants to provide acceptable solubilization and removal of food soils, especially greasy soils, from dishware being washed in aqueous solutions formed from such products.

In addition to being suitable for cleaning dishes, such compositions will also desirably possess a number of characteristics which enhance the aesthetics of the manual dishwashing operation. Thus, useful hand dishwashing liquids or gels will utilize components which enhance the sudsing performance of the wash solutions formed from such products. Sudsing performance entails both the production of a suitable amount of suds in the wash water initially as well as the formation of suds which last well into the dishwashing process.

Another aesthetics-related feature of suitable manual dishwashing products relates to rinsing performance. Use of highly concentrated or high concentrations of dishwashing products can require an increase in the amount of rinsing that is needed in order to remove detergent composition from the dish article once manual agitation and washing is complete. For example, in direct application conditions, the dish article is dampened and the detergent composition is applied to the dish article in a highly concentrated form or even in its undiluted form. After manual agitation and wiping by the consumer, the article is placed under running water to be rinsed. The article is thus held under the rinsing water until the consumer is satisfied that the remaining detergent material on the dish article has been removed. Completion of rinsing is often evaluated by the complete removal of suds from the dish article and by the lack of a greasy or slippery feel to the dish article to the touch. Under certain consumer washing conditions such as in ambient water conditions and direct application conditions, this problem of achieving complete rinsing is particularly noticeable.

Yet another aesthetics-related feature of suitable manual dishwashing products involves the skin "feel" and skin conditioning benefits which such products can impart to dishwashing solutions made therefrom. With respect to skin "feel", some consumers prefer that the dishwashing solution formed from the product not be slimy or slippery feeling to their hands. Furthermore, acceptable manual dishwashing products should also be mild to the skin, particularly to the hands, and should not cause skin dryness, chapping or roughness. Such skin complaints largely result from the removal of natural oils from the skin during dishwashing. Thus, the manual dishwashing composition should desirably be effective at removing grease from plates but should not serve to remove natural oils from the skin.

Given the foregoing, there is a continuing need to formulate manual dishwashing liquids and gels that provide an acceptable and desirable balance between cleaning performance and product aesthetics. Accordingly, it is an object of the present invention to provide light-duty liquid or gel dishwashing compositions which are especially effective at removing food soils from dirty dishware in the context of a manual dishwashing operation.

It is a further object of the present invention to provide such compositions having suitable and desirable sudsing performance.

It is the further object of this invention to provide such compositions having desirable rinsability characteristics.

It is yet a further object of this invention to provide such compositions which impart a desirable non-slippery skin feel to washing solutions formed therefrom and which provide washing solutions that are desirably mild and non-irritating to the skin.

It has been found that certain selected combinations of surfactants, hydrotropes and skin conditioning enzymes can be made to provide dishwashing compositions which achieve the foregoing objectives. The elements of this selected combination of ingredients are described as follows:

SUMMARY OF THE INVENTION

In its composition aspect, the present invention relates to light-duty liquid or gel dishwashing detergent compositions comprising, by weight, from about 5% to 98% of certain detergent surfactants, from about 3% to 20% of a two-component skin feel and rinsability enhancing system and from about 0.001% to 5% of an active protease enzyme. Such compositions have a pH of from about 4 to 11.

The detergent surfactants used in such compositions include polyhydroxy fatty acid amides; nonionic fatty alkypolyglucosides; $C_{8-22}$ alkyl sulfates; $C_{9-15}$ alkyl benzene sulfonates, $C_{8-22}$ alkyl ether sulfates; $C_{8-22}$ olefin sulfonates; $C_{8-22}$ paraffin sulfonates; $C_{8-22}$ alkyl glyceryl ether sulfonates; fatty acid ester sulfonates; secondary alcohol sulfates; $C_{12-16}$ alkyl ethoxy carboxylates; $C_{11-16}$ secondary soaps; ampholytic detergent surfactants; and zwitterionic detergent surfactants. Mixtures of these detergent surfactants are also contemplated.

The skin feel and rinsability enhancing system essentially comprises both an ethoxylated alcohol nonionic surfactant component and a hydrotrope component. The weight ratio of the nonionic surfactant component to the hydrotrope component ranges from about 10:1 to 1:10.

The nonionic surfactant component of the skin feel/rinsability enhancing system comprises $C_6$–$C_{12}$ alkanols condensed with from about 5 to 15 moles of ethylene oxide. The hydrotrope component of the skin feel/rinsability enhancing system comprises a material selected from $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these materials.

In its method aspect, the present invention relates to a method for soaking hands in the context of a manual dishwashing operation, with improved skin feel andreduced skin irritation resulting therefrom. Such a method comprises preparing an aqueous dishwashing solution from an effective amount of a dishwashing detergent composition of the general type hereinbefore described and thereafter immersing the hands of the dishwasher in said dishwashing solution for a period of time which is effective to complete hand dishwashing operations.

DETAILED DESCRIPTION OF THE INVENTION

The light-duty liquid or gel dishwashing detergent compositions of the present invention contain three essential components. These components are:

(1) detergent surfactants;

(2) a nonionic surfactant- and hydrotrope-containing skin feel and rinsability enhancing system; and (3) low levels of active protease enzyme.

Optional ingredients can be added to complement or enhance the various performance and aesthetics characteristics of the compositions herein. The term "light-duty dishwashing detergent composition" as used herein refers to those compositions which are employed in manual (i.e. hand) dishwashing. Such compositions are generally high foaming in nature.

Detergent Surfactants

The compositions of this invention contain from about 5% to about 98%, preferably from about 10% to about 70%, most preferably from about 20% to about 60% of detergent surfactant.

Included in this category are several anionic surfactants commonly used in liquid or gel dishwashing detergents. The cations associated with these anionic surfactants are preferably selected from the group consisting of calcium, sodium, potassium, magnesium, ammonium or alkanol-ammonium, and mixtures thereof, preferably sodium, ammonium, calcium and magnesium and/or mixtures thereof. Examples of anionic surfactants that are useful in the present invention are the following:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $ROSO_3^-M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety. Surfactants of this general type are commercially available as, for example, Hostapur SAS from Hoechst Celanese.

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, with less than 30, preferably less than 12, moles of ethylene oxide. The alkyl ether sulfates have the formula:

$$RO(C_2H_4O)_xSO3^-M^+$$

where R is a $C_{8-22}$ alkyl group, x is 1–30, and M is a mono- or divalent cation. Alkyl ether sulfates are preferred for use herein and will preferably comprise from about 15% to 35% by weight of the compositions herein.

(6) Alkyl glyceryl ether sulfonates having 8 to 22 carbon atoms, preferably 12 to 16 carbon atoms, in the alkyl moiety.

(7) Fatty acid ester sulfonates of the formula:

$$R_1—CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a mono- or divalent cation.

(8) Secondary alcohol sulfates having 6 to 18 carbon atoms, preferably 8 to 16 carbon atoms.

(9) Alkyl ethoxy carboxylates of the generic formula $$RO(CH_2CH_2O)_xCH_2COO^-M^+$$

wherein R is a $C_{12}$ to $C_{16}$ alkyl group, x ranges from 0 to about 10, and the ethoxylate distribution is such that, on a weight basis, the amount of material where x is 0 is less than about 20%, preferably less than about 15%, most preferably less than about 10%, and the amount of material where x is greater than 7 is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation preferably chosen from alkali metal, ammonium, mono-, di-, and tri-ethanolammonium, most preferably from sodium, potassium, ammonium, and mixtures thereof. The preferred alkyl ethoxy carboxylates are those where R is a $C_{12}$ to $C_{14}$ alkyl group.

(10) The following general structures illustrate some of the "special soaps", or their precursor acids (a.k.a. $C_{11-16}$ alkyl carboxyls) employed in this invention:

A. A highly preferred class of soaps used herein comprises the $C_{10}$–$C_{16}$ secondary carboxyl materials of the formula $R^3$ $CH(R^4)COOM$, wherein $R^3$ is $CH_3(CH_2)_x$ and $R^4$ is $CH_3(CH_2)_y$, wherein y can be 0 or an integer from 1 to 6, x is an integer from 6 to 12 and the sum of (x+y) is 6–12, preferably 7–11, most preferably 8–9.

B. Another class of special soaps useful herein comprises those carboxyl compounds wherein the carboxyl substituent is on a ring hydrocarbyl unit, i.e., secondary soaps of the formula $R^5$—$R^6$—COOM, wherein $R^5$ is $C_7$—$C_{10}$, preferably $C_8$–$C_9$, alkyl or alkenyl and $R^6$ is a ring structure, such as benzene, cyclopentane, cyclohexane, and the like. (Note: $R^5$ can be in the ortho, meta or para position relative to the carboxyl on the ring.)

C. Still another class of soaps includes the $C_{10}$–C18 primary and secondary carboxyl compounds of the formula $R^7CH(R^8)COOM$, wherein the sum of the carbons in $R^7$ and $R^8$ is 8–16, $R^7$ is of the form $CH_3$—$(CHR^9)_x$ and $R^8$ is of the form H—$(CHR^9)_y$, where x and y are integers in the range 0–15 and $R^9$ is H or a $C_{1-4}$ linear or branched alkyl group. $R^9$ can be any combination of H and $C_{1-4}$ linear or branched alkyl group members within a single —$(CHR^9)_{x,y}$ group; however, each molecule in this class must contain at least one $R^9$ that is not H. These types of molecules can be made by numerous methods, e.g. by hydroformulation and oxidation of branched olefins, hydroxycarboxylation of branched olefins, oxidation of the products of Guerbet reaction involving branched oxoalcohols. The branched olefins can be derived by oligomerization of shorter olefins, e.g. butene, isobutylene, branched hexene, propylene and pentene.

D. Yet another class of soaps includes the $C_{10}$–$C_{18}$ tertiary carboxyl compounds, e.g., neo-acids, of the formula $R^{10}CR^{11}(R^{12})COOM$, wherein the sum of the carbons in $R^{10}$, $R^{11}$ and $R^{12}$ is 8–16. $R^{10}$, $R^{11}$, and $R^{12}$ are of the form $CH_3$—$(CHR^{13})_x$, where x is an integer in the range 0–13, and $R^{13}$ is H or a $C_{1-4}$ linear or branched alkyl group. Note that $R^{13}$ can be any combination of H and $C_{1-4}$ linear or branched alkyl group members within a single —$(CHR^{13})_x$ group. These types of molecules result from addition of a carboxyl group to a branched olefin, e.g., by the Koch reaction. Commercial examples include the neodecanoic acid manufactured by Exxon, and the Versatic™ acids manufactured by Shell.

In each of the above formulas A, B, C and D, the species M can be any suitable, especially water-solubilizing, counterion, e.g., H, alkali metal, alkaline earth metal, ammonium, alkanolammonium, di- and tri-alkanolammonium, $C_1$–$C_5$ alkyl substituted ammonium and the like. Sodium is convenient, as is diethanolammonium.

Preferred secondary special soaps for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid; 2-pentyl-1-heptanoic acid; 2-methyl-1-dodecanoic acid; 2-ethyl-1-undecanoic acid; 2-propyl-l-decanoic acid; 2-butyl-1-nonanoic acid; 2-pentyl-1-octanoic acid and mixtures thereof

(11) Mixtures of these anionic surfactant types.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Other useful surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

The compositions herein may also contain a polyhydroxy fatty acid amide surfactant of the structural formula:

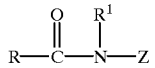

(I)

wherein: $R^1$ is H; $C_1$–$C_6$ hydrocarbyl, i.e., $C_pH_{2p+1}$; 2-hydroxy ethyl; 2-hydroxy propyl; or a mixture thereof, preferably $C_1$–$C_4$ alkyl, more preferably $C_1$ or $C_2$ alkyl, most preferably $C_1$ alkyl (i.e., methyl); and R is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, U.S. Pat. No. 1,985,424, issued Dec. 25, 1934 to Piggott, 5,188,769, Connor et al, issued Feb. 23, 1993 and 5,194,639, Connor et al, issued March 16, 1993, each of which is incorporated herein by reference. Polyhydroxy fatty acid amides are also highly preferred for use in the dishwashing detergent compositions herein. Preferably such materials will comprise from about 3% to 8% by weight of the composition.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to 24 carbon atoms and one contains an anionic water-solubilizing group. Particularly preferred zwitterionic materials are the ethoxylated ammonium sulfonates and sulfates disclosed in U.S. Pats. Nos. 3,925,262, Laughlin et al, issued Dec. 9, 1975 and 3,929,262, Laughlin et al, issued Dec. 30, 1975, said patents being incorporated herein by reference.

Ampholytic surfactants include derivatives of aliphatic or heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

Skin Feel and Rinsability Enhancing System

A second essential component of the dishwashing compositions herein is a skin feel and rinsability enhancing system. Such a system will generally comprise from about 3% to 20% by weight of the compositions herein. More preferably the skin feel/rinsability enhancing system will comprise from about 4% to 15% by weight of the compositions herein, most preferably from about 6% to 12% by weight of the compositions herein.

The skin feel and rinsability enhancing system itself comprises two components. These are the ethoxylated nonionic surfactant component and the hydrotrope component.

1) Ethoxylated Nonionic Surfactants

One component of the skin feel/rinsability enhancing system comprises a certain type of relatively short chain ethoxylated alcohol nonionic surfactant. Such ethoxylated alcohols are the $C_6$–$C_{12}$ alkanols condensed with from about 5 to 15 moles of ethylene oxide. More preferably, such nonionic surfactants comprise the $C_8$–$C_{11}$ alkanols condensed with from about 8 to 12 moles of ethylene oxide and will be present in the composition to the extent of from about 4% to 8% by weight.

2) Hydrotropes

The second component of the skin feel/rinsability enhancing system comprises certain types of hydrotrope materials. Hydrotropes suitable for use in the skin feel/rinsability enhancing system of the compositions herein include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials.

Suitable $C_{1-C3}$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof.

Suitable $C_1$–$C_8$ carboxylic sulfate or sulfonate salts are any water soluble salts or organic compounds comprising I to 8 carbon atoms (exclusive of substituent groups), which are substituted with sulfate or sulfonate and have at least one carboxylic group. The substituted organic compound may be cyclic, acylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof These preferred hydrotrope materials will be present in the composition to the extent of from about 2% to 7% by weight.

3) Nonionic/Hydrotrope Ratio

Within the skin feel/rinsability enhancing system, the weight ratio of ethoxylated nonionic surfactants to hydrotropes will generally range from about 1:10 to 10:1. More preferably the nonionic/hydrotrope ratio will range from about 5:1 to 1:5. Most preferably, the ratio of nonionic to hydrotrope will range from about 3:1 to 1:3.

Protease Enzyme

The compositions of this invention will generally contain from about 0.001% to about 5%, more preferably from about 0.003% to about 4%, most preferably from about 0.005% to about 3%, by weight, of active protease, i.e., proteolytic, enzyme. Protease activity may be expressed in Anson units (AU.) per kilogram of detergent composition. Levels of from 0.01 to about 150, preferably from about 0.05 to about 80, most preferably from about 0.1 to about 40 AU. per kilogram have been found to be acceptable in compositions of the present invention.

The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15®) (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent EP-B-251,446, granted Dec. 28, 1994 and published Jan. 7, 1988 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Preferred proteolytic enzymes, then, are selected from the group consisting of Alcalase® (Novo Industri A/S), BPN', Protease A and Protease B (Genencor), and mixtures thereof. Protease B is most preferred.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Usefil proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Protease enzymes can provide a skin care benefit in the context of the dishwashing detergent products and methods herein. It is believed that the protease functions primarily by providing a desquamatory action to the detergent composition. It is believed that the proteases remove damaged (e.g. dry) skin cells on the surface of the skin, thereby reducing the rough feel associated therewith. The protease removes the effect of prior damage to the skin, giving the skin a fresher, more youthful appearance and feel. When the protease is combined with a detergent surfactant and the skin feel/rinsability enhancing system, the overall effect is to promote the health of the skin and to provide the consumer with a perceived mildness or skin feel/appearance advantage over other similar detergent compositions which do not contain protease while still maintaining good cleaning performance.

Composition pH

The dishwashing compositions of the present invention will generally have a pH of from about 4 to 11. More preferably, the compositions herein will be alkaline in nature with a pH of from about 7 to 10.

Dishwashing compositions of the invention will be subjected to acidic stresses created by food soils when put to use, i.e., diluted and applied to soiled dishes. If a composition with a pH greater than 7 is to be more effective, it should contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids or lower alcohol amines like mono-, di-, and tri-ethanolamine. Other preferred nitrogen-containing buffering agents are 2-amino-2-ethyl-1,3-propanediol, 2-amino-2-methyl-propanol, 2-amino-2-methyl-1,3-propanediol, tris-(hydroxymethyl) aminomethane (a.k.a. tris) and disodium glutamate. N-methyl diethanolamine, 1,3-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable.

The buffering agent, if used, is present in the compositions of the invention hereof at a level of from about 0.1% to 15%, preferably from about 1% to 10%, most preferably from about 2% to 8%, by weight of the composition.

Optional Ingredients

Preferred optional ingredients in the dishwashing compositions herein include suds boosters/stabilizers, a stabilizing system for the protease enzyme and calcium and/or other inorganic ions. These and other optional ingredients are described as follows:

a) Suds Boosters

The compositions herein will preferably include from about 1% to 20%, preferably from about 2% to 15%, of suds boosters such as betaines, certain relatively long-chain alcohol/ethylene oxide condensates, fatty acid amides, amine oxide semi-polar nonionics, sultaines, complex betaines and cationic surfactants.

The compositions of this invention can contain betaine detergent surfactants having the general formula:

$$R—\overset{(+)}{N}(R^1)_2—R^2\overset{(-)}{CO_2}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e,g., they can be derived from naturally occurring fatty acids; olefins such as those prepared by Ziegler, or Oxo processes; or from olefins separated from petroleum either with or without "cracking".

The alcohol/ethylene oxide condensate suds boosters are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of relatively long-chain aliphatic alcohols with ethylene oxide. The alkyl chain of the aliphatic alcohol can either be straight or branched and generally contains from about 14 to about 18, preferably from about 14 to about 16, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful as suds boosters herein include the ammonia, monoethanol, and diethanol amides of fatty acids having an acyl moiety containing from about 8 to about 18 carbon atoms and represented by the general formula:

$$R_1—CO—N(H)_{m-1}(R_2OH)_{3-m}$$

wherein $R_1$ is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula:

$$R_1(C_2H_4O)_nN^+R_2R_3—O^-$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

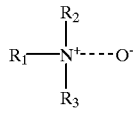

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

The sultaines useful as suds boosters in the present invention are those compounds having the formula $(R(R^1)_2N^+R^2SO_3$— wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$-$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12-14}$ amido propyl ammonio-2-hydroxypropyl sultaine, $C_{12-14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

The complex betaines for use as suds boosters herein have the formula:

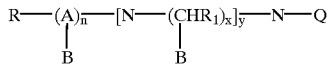

(I)

wherein R is a hydrocarbon group having from 7 to 22 carbon atoms, A is the group (C(O), n is 0 or 1, $R_1$ is hydrogen or a lower alkyl group, x is 2 or 3, y is an integer of 0 to 4, Q is the group —$R_2$COOM wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

The composition of this invention can also contain certain cationic quaternary ammonium surfactants of the formula:

$$[R^1(OR^2)_y][R^3(OR^2)_y]_2R^4N^+X^-$$

or amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethylammonium salts, $C_{8-16}$ alkyl di(hydroxyethyl)methylammonium salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of the above, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

The suds boosters used in the compositions of this invention can contain any one or mixture of the suds boosters listed above.

b) Enzyme Stabilizing System

The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the protease enzyme of the present invention. Such stabilizing systems can comprise calcium ion, boric acid, propylene glycol, short chain carboxylic acid, boronic acid, polyhydroxyl compounds and mixtures thereof such as are described in U.S. Pat. Nos. 4,261,868, Hora et al, issued Apr. 14, 1981; 4,404,115, Tai, issued Sep. 13, 1983; 4,318,818, Letton et al; 4,243,543, Guildert et al issued Jan. 6, 1981; 4,462,922, Boskamp, issued Jul. 31, 1984; 4,532,064, Boskamp, issued Jul. 30, 1985; and 4,537,707, Severson Jr., issued Aug. 27, 1985, all of which are incorporated herein by reference.

Additionally, from 0 to about 10%, preferably from about 0.01% to about 6% by weight, of chlorine bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbamate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, percarbonate, phosphate, condensed phosphate, acetate, benzoate, citrate, formate, lactate, malate, tartrate, salicylate, etc. and mixtures thereof can also be used. The preferred ammonium salts or other salts of the specific chlorine scavenger anions can either replace the suds controlling agent or be added in addition to the suds controlling agent.

Although ammonium salts can be admixed with the detergent composition, they are prone to adsorb water and/or give off ammonia gas. Accordingly, it is better if they are protected in a particle like that described in U.S. Pat. No. 4,652,392, Baginski et al, which is incorporated herein by reference.

c) Calcium and/or Magnesium Ions

The presence of calcium and/or magnesium (divalent) ions improves the cleaning of greasy soils for various compositions, i.e., compositions containing alkyl ethoxy sulfates or carboxylates and/or polyhydroxy fatty acid amides. This is especially true when the compositions are used in softened water that contains few divalent ions. It is believed that calcium and/or magnesium ions increase the packing of the surfactants at the oil/water interface, thereby reducing interfacial tension and improving grease cleaning.

Compositions of the invention herein containing magnesium and/or calcium ions exhibit good grease removal, manifest mildness to the skin, and provide good storage stability. The ions are present in the compositions hereof at an active level of from about 0.1% to 4%, preferably from about 0.3% to 3.5%, more preferably from about 0.5% to 1%, by weight.

Preferably, the magnesium or calcium ions are added as a hydroxide, chloride, acetate, formate, oxide or nitrate salt to the compositions of the present invention. Calcium ions may also be added as salts of the hydrotrope.

The amount of calcium or magnesium ions present in compositions of the invention will be dependent upon the amount of total surfactant present therein, including the amount of alkyl ethoxy carboxylates and polyhydroxy fatty acid amide. When calcium ions are present in the compositions of this invention, the molar ratio of calcium ions to total anionic surfactant is from about 0.25:1 to about 2:1 for compositions of the invention.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed herein below may also be necessary.

d) Other Optional Components

In addition to the essential and preferred optional ingredients described hereinbefore, the compositions contain other conventional ingredients, especially those associated with dishwashing compositions.

The compositions can also contain from about 0.01% to about 15%, preferably from about 1% to about 10%, by weight nonionic detergent surfactants which do not foam and may even inhibit foaming. Suitable nonionic detergents are disclosed in U.S. Pat. No. 4,321,165, Smith et al (Mar. 23, 1982) 4,316,824 Pancheri (Feb. 234, 1982) and U.S. Pat. No. 3,929,678, Laughlin et al., (Dec. 30, 1975). Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from 6 to 12 carbon atoms in either a straight- or branched-chain configuration with the alkylene oxide. Commercially available nonionic surfactants of this type include Igepal™ CO-630, marketed by the GAF Corporation; and Triton™ X-45, X-114, X-100, and X-102, all marketed by the Rohm & Haas Company.

2. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility.

3. The condensation products of ethylene oxide with the product resulting from the reaction of propylene oxide and ethylenediamine.

4. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. U.S. Pat. Nos. 4,393,203 and 4,732,704, incorporated herein by reference, also describe acceptable surfactants.

Other conventional optional ingredients which are usually used in additive levels of below about 5% include opacifiers, antioxidants, bactericides, dyes, perfumes, and the like.

Optional enzymes such as lipase and/or amylase may be added to the compositions of the present invention for additional cleaning benefits.

Detergency builders can also be present in amounts from 0% to about 50%, preferably from about 2% to about 30%, most preferably from about 5% to about 15%. It is typical in light-duty liquid or gel dishwashing detergent compositions to have no detergent builder present. However, certain compositions containing magnesium or calcium ions may require the additional presence of low levels of, preferably from 0 to about 10%, more preferably from about 0.5% to about 3%, chelating agents selected from the group consisting of bicine/bis(2-ethanol)blycine), citrate N-(2-hydroxylethyl) iminodiacetic acid (HIDA), N-(2,3-dihydroxy-propyl) iminodiacetic acid (GIDA), and their alkali metal salts. Some of these chelating agents are also identified in the art as detergency builders.

The compositions of this invention may contain for chelating and detergency purposes from about 0.001% to about 15% of certain alkylpolyethoxypolycarboxlyate surfactants of the general formula

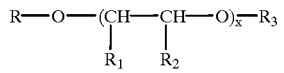

wherein R is a $C_6$ to $C_{18}$ alkyl group, x ranges from about 1 to about 24, $R_1$ and $R_2$ are selected from the group consisting of hydrogen, methyl acid radical succinic acid radical hydroxy succinic acid radical, and mixtures thereof, wherein at least one $R_1$ or $R_2$ is a succinic acid and/or hydroxysuccinic acid radical. An example of a commercially available alkylpolyethoxypoly-carboxylate which can be employed in the present invention is POLY-TERGENT C, Olin Corporation, Cheshire, Conn.

The alkylpolyethoxypolycarboxylate surfactant is selected on the basis of its degree of hydrophilicity. A balance of carboxylation and ethoxylation is required in the alkylpolyethoxypolycarboxylate in order to achieve maximum chelating benefits without affecting the cleaning benefits which is associated with the divalent ions or the sudsing of the liquid or gel dishwashing detergent compositions. The number of carboxylate groups dictates the chelating ability, too much carboxylation will result in too strong a chelator and prevent cleaning by the divalent ions. A high degree of ethoxylation is desired for mildness and solubility; however, too high a level will affect sudsing. Therefore, an alkylpolyethoxypolycarboxylate with a modest degree of ethoxylation and minimal carboxylation is desirable.

Other desirable ingredients include diluents and solvents. Diluents can be inorganic salts, such as sodium sulfate, sodium chloride, sodium bicarbonate, etc., and the solvents include water, lower molecular weight alcohols such as ethyl alcohol, isopropyl alcohol, etc. In liquid detergent compositions there will typically be from 0% to about 90%, preferably from about 20% to about 70%, most preferably from about 40% to about 60% of water, and from 0% to about 50%, most preferably from about 3% to about 10% of ingredients to promote solubility, including ethyl or isopropyl alcohol, etc.

Composition Preparation

The liquid or gel dishwashing detergent compositions herein may be prepared by combining the essential and optional ingredients together in any convenient order using suitable agitation to form a homogeneous product. Preferred methods for making detergent compositions of the type disclosed herein, and for preparing various components of such compositons, are described in greater detail in Ofosu-Asante: U.S. Pat. No. 5,474,710: Issued Dec. 12, 1995, incorporated herein by reference.

Dishwashing Method

Soiled dishes can be contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgment of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another method of use typical of Japanese dishwashing habits involves direct application of the detergent compositions herein, either neat or diluted in a dispenser bottle, onto the soiled dishes to be cleaned. This can be accomplished by using a device for absorbing liquid dishwashing detergent, such as a sponge or dishrag, which is placed directly into a separate quantity of undiluted or somewhat diluted liquid dishwashing composition for a period of time typically ranging from about 1 to about 5 seconds. The absorbing device, and consequently the undiluted or somewhat diluted liquid dishwashing composition, can then be contacted individually with the surface of each of the soiled dishes to remove food soil. The absorbing device is typically contacted with each dish surface for a period of time ranging from about 1 to about 10 seconds, although the actual time of application will be dependent upon factors such as the degree of soiling of the dish. The contacting of the absorbing device with the dish surface is preferably accompanied by concurrent scrubbing. Prior to contact and scrubbing, this method may involve immersing the soiled dishes into a water bath without any liquid dishwashing detergent. After scrubbing, the dish can be rinsed under running water.

As used herein, all percentages, parts, and ratios are by weight unless otherwise stated.

The following Examples illustrate the invention and facilitate its understanding.

EXAMPLE I

A $C_{10}E_8$ alcohol ethoxylate, calcium xylene sulfonate hydrotrope and protease enzyme are all added, at levels of 6.0%, 5.0% and 0.05% respectively, (Composition A) to an aqueous light-duty dishwashing liquid (Composition B) comprising 20% sodium $C_{12-13}$ alkylpolyethoxylate(12) sulfate, 4% $C_{12}$ glucose amide and 4% $C_{12}$ alkyldimethyl amine oxide.

A home usage test is conducted with 120 panelists. Half of them use the protease- and rinse/feel system-containing product (Composition A) and the other half use the non-enzyme product (Composition B) for two weeks. They are then asked to compare the test product with their own product. Composition A is rated significantly higher (>95% confidence level) for product mildness, softness of hands, and smoothness of hands. Composition A also feels less slippery and slimy to the panelists than Composition B.

Similarly, in a hand immersion test, panelists are asked to soak their hands in the two different product solutions for 30 minutes each day, Monday through Thursday. Their hand conditions are then evaluated by expert graders to evaluate the overall health and the extent of flakiness and panelist preferences between treatments are determined. Such testing indicates that Composition A treated skin is moister and smoother than Composition B and is more preferred by the panelists.

EXAMPLE II

Light-duty liquid dishwashing detergent formulae are prepared as follows:

| Ingredient | Composition C | D | E |
|---|---|---|---|
| | % Weight | | |
| Ammonium $C_{12-13}$ alkyl ethoxy$_{(1)}$ sulfate | 28.50 | 28.50 | 28.50 |
| Coconut amine oxide | 2.61 | 2.61 | 2.61 |
| Betaine/Tetronic 704 ® | 0.87/0.10 | 0.87/0.10 | 0.87/0.10 |
| Alcohol Ethoxylate $C_8E_{11}$ | 5.00 | 0.00 | 5.00 |
| Ammonium xylene sulfonate | 0.00 | 4.00 | 4.00 |
| Ethanol | 4.00 | 4.00 | 4.00 |
| Ammonium citrate | 0.06 | 0.06 | 0.06 |
| Magnesium chloride | 3.32 | 3.32 | 3.32 |
| Ammonium sulfate | 0.08 | 0.08 | 0.08 |
| Hydrogen peroxide | 200 ppm | 200 ppm | 200 ppm |
| Perfume | 0.18 | 0.18 | 0.18 |
| Maxatase ® protease | 0.50 | 0.50 | 0.50 |
| Water and minors | | Balance | |

When Compositions C, D and E are used in a manual dishwashing operation, Composition E of the present invention which contains both $C_8E_{11}$ alcohol ethoxylate and xylene sulfonate hydrotrope provides a washing solution that is easier to rinse off dishware than solutions formed from either Composition C or Composition D.

EXAMPLE III

Light-duty liquid dishwashing detergent formulae are prepared as follows:

| Ingredient | Composition F | G | H |
|---|---|---|---|
| | % Weight | | |
| Ammonium $C_{12-13}$ alkyl ethoxy$_{(1)}$ sulfate | 15.500 | 15.500 | 15.500 |
| Ammonium alkyl ethoxy (Ave 6.5) sulfate | 11.900 | 11.900 | 11.900 |
| Amine oxide | 5.000 | 5.000 | 5.000 |
| Alcohol Ethoxylate $C_{10}E_9$ | 4.000 | 5.000 | 4.000 |
| Ammonium xylene sulfonate | 4.000 | 5.000 | 4.000 |
| Ethanol | 5.500 | 5.500 | 5.500 |
| Sodium chloride | 1.000 | 1.000 | 1.000 |
| Ammonium citrate | 0.100 | 0.100 | 0.100 |
| Perfume | 0.090 | 0.090 | 0.090 |
| Hydrogen peroxide | 0.165 | 0.165 | 0.165 |
| Protease B | 0.000 | 0.050 | 0.150 |
| Water and minors | | Balance | |

A hand immersion test in which panelists are asked to soak their hands twice a day for 15 minutes each for four days results in significantly improved skin condition for Compositions (G) and (H) as compared to control (F).

EXAMPLE IV

Light-duty liquid dishwashing detergent formulae are prepared as follows:

| Ingredient | Composition I | J | K |
|---|---|---|---|
| | % Weight | | |
| Sodium $C_{12-13}$ alkyl ethoxy (1) sulfate | 6.000 | 6.000 | 6.000 |
| Sodium $C_{12-13}$ alkyl ethoxy (1–3) sulfate | 13.200 | 13.200 | 13.200 |
| $C_{12}$ Glucose Amide | 6.000 | 6.000 | 6.000 |
| Coconut amine oxide | 2.000 | 2.000 | 2.000 |
| Hydrogen peroxide | 0.006 | 0.006 | 0.006 |
| Ethanol | 5.500 | 5.500 | 5.500 |
| Calcium xylene sulfonate | 2.500 | 3.000 | 4.000 |
| Neodol ® $C_{11}E_9$ | 5.000 | 5.000 | 5.000 |
| Sodium diethylene penta acetate (40%) | 0.030 | 0.030 | 0.030 |
| Perfume | 0.090 | 0.090 | 0.090 |
| Magnesium++ (added as chloride) sodium sulfate | 0.060 | 0.060 | 0.060 |
| Savinase ® protease | 0.000 | 0.050 | 0.010 |
| Water and minors | | Balance | |
| pH @ 10% (as made) | 7.100 | 7.100 | 7.100 |

A hand immersion test consisting of eighteen panelists soaking their hands hands in test products once a day for 30 minutes for a total of four days results in significant improvement in overall skin condition for both levels of protease-containing compositions (J and K) as compared to control (I).

EXAMPLE V

Concentrated light-duty liquid dishwashing detergent compositions of the present invention are prepared as follows:

| Ingredient | Composition L | M | N | O |
|---|---|---|---|---|
| | % Weight | | | |
| Diethylenetriamine penta acetate | 0.06 | 0.06 | 0.06 | 0.06 |
| Neodol $C_{10}E_8$ | 5.00 | 4.00 | 5.50 | 3.00 |
| Ethanol | 9.15 | 9.15 | 9.15 | 9.15 |
| Magnesium hydroxide | 2.18 | 2.18 | 2.18 | 2.18 |
| Sucrose | 1.50 | 1.50 | 1.50 | 1.50 |
| Alkyl ethoxy(1.0) sulfate | 34.14 | 34.14 | 34.14 | 34.24 |
| Sodium hydroxide | 1.13 | 1.13 | 1.13 | 1.13 |
| Polyhydroxy fatty acid amide | 6.50 | 6.50 | 6.50 | 6.50 |
| Amine oxide | 3.00 | 3.00 | 3.00 | 3.00 |
| Cocoamidopropyl betaine | 2.00 | 2.00 | 2.00 | 2.00 |
| Perfume | 0.23 | 0.23 | 0.23 | 0.23 |
| Calcium xylene sulfonate | 2.05 | 2.05 | 3.70 | 4.20 |
| Alkyl diphenyl oxide disulfonate[1] | 0.00 | 0.00 | 2.30 | 2.30 |
| Calcium formate | 0.53 | 0.53 | 1.14 | 1.14 |
| Protease B | 0.00 | 0.08 | 0.05 | 0.08 |
| Water and minors | Balance | | | |

[1]DOWFAX 2A

Other compositions of the present invention are obtained when Protease B is substituted with other proteases such as Maxacal®, Savinase®, Esperase® and BPN'.

What is claimed is:

1. A light-duty liquid or gel dishwashing detergent composition that provides beneficial skin conditioning, skin feel and rinsability aesthetics, which composition comprises:

(a) from about 5% to 98% by weight of a detergent surfactant selected from the group consisting of polyhydroxy fatty acid amides; nonionic fatty alkylpolyglycosides; $C_{8-22}$ alkyl sulfates; $C_{9-15}$ alkyl benzene sulfonates; $C_{8-22}$ alkyl ether sulfates; $C_{8-22}$ olefin sulfonates; $C_{8-22}$ paraffin sulfonates; $C_{8-22}$ alkyl glyceryl ether sulfonates; fatty acid ester sulfonates; secondary alcohol sulfates; $C_{12-16}$ alkyl ethoxy carboxylates; $C_{11-16}$ secondary soaps; ampholytic detergent surfactants; zwitterionic detergent surfactants; and mixtures thereof;

(b) from about 3% to 20% by weight of a skin feel and rinsability enhancing system which comprises i) a nonionic surfactant component comprising $C_6$–$C_{12}$ alkanols condensed with from about 5 to 15 moles of ethylene oxide; and ii) a hydrotrope component comprising $C_1$–$C_3$ alkyl aryl sulfonates, $C_6$–$C_{12}$ alkanols, $C_1$–$C_6$ carboxylic sulfates or sulfonates, urea, $C_1$–$C_4$ hydrocarboxylates, $C_1$–$C_4$ carboxylates, $C_2$–$C_4$ organic diacids or mixtures of these hydrotrope materials;

in a nonionic surfactant to hydrotrope weight ratio of from about 10:1 to 1:10; and (c) from about 0.001 to 5% by weight of an active protease enzyme;

(d) from about 0.1 to about 4 % by weight of magnesium ions;

said composition having a pH of from about 4 to 11.

2. A composition according to claim 1 wherein:

(a) the detergent surfactant comprises from about 20% to 60% by weight of the composition and is selected from the group consisting of polyhydroxy fatty acid amides; $C_{8-22}$ alkyl sulfates; $C_{8-22}$ alkyl ether sulfates; $C_{12-16}$ alkyl ethoxy carboxylates; and $C_{11}$–$C_{16}$ secondary soaps;

(b) the skin feel and rinsability enhancing system comprises from about 6% to 12% by weight of the composition;

(c) the nonionic surfactant component of the skin feel and rinsability enhancing system comprises $C_8$–$C_{11}$ alkanols condensed with from about 8 to 12 moles of ethylene oxide;

(d) the hydrotrope component of the skin feel and rinsability enhancing system is selected from the group consisting of sodium, potassium, calcium and ammonium xylene sulfonates; sodium, potassium, calcium and ammonium toluene sulfonates; sodium, potassium, calcium and ammonium cumene sulfonates; and sodium, potassium, calcium and and mixtures of said hydrotrope materials;

(e) the weight ratio of ethoxylated alcohol nonionic surfactant to hydrotrope within the skin feel and rinsability enhancing system ranges from about 1:5 to 5: 1; and (f) the protease enzyme component comprises from about 0.005% to 3% by weight of the composition and is a serine proteolytic enzyme obtained from *Bacillus subtilis, Bacillus licheniformis* or mixtures thereof;

(g) from about 0.1 to about 4 % by weight of magnesium ions.

3. A composition according to claim 2 which additionally contains from about 1% to 20% by weight of a suds booster selected from the group consisting of betaines, long chain alcohol ethoxylates, fatty acid amides, amine oxide semipolar nonionics, sultaines, complex betaines, cationic surfactants and mixtures thereof.

4. A composition according to claim 3 which additionally contains from about 0.1% to about 4% by weight of calcium ions.

5. A composition according to claim 4 which additionally contains from about 0.001% to about 10% of an enzyme stabilizing system.

6. A composition according to claim 5 wherein the composition pH is between about 7 and 10.

7. A light-duty liquid or gel dishwashing detergent composition that provides beneficial skin conditioning, skin feel and rinsability aesthetics, which composition comprises:

(a) from about 15% to 35% by weight of an anionic surfactant selected from the group consisting of $C_8$–$C_{22}$ alkyl ether sulfates containing from about 1 to 30 ethylene oxide moieties per molecule;

(b) from about 3% to 8% by weight of a polyhydroxy fatty acid amide nonionic surfactant of the formula:

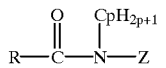

wherein R is a $C_9$–$C_{17}$ alkyl or alkenyl, p is from 1 to 6; and Z is glycityl derived from a reduced sugar or alkoxylated derivatives thereof;

(c) from about 4% to 8% by weight of an ethoxylated alcohol nonionic surfactant comprising one or more $C_8$–$C_{11}$ alkanols condensed with from about 8 to 12 moles of ethylene oxide;

(d) from about 2% to 7% by weight of a hydrotrope selected from the group consisting of sodium, potassium, ammonium and calcium xylene and toluene sulfonates;

(e) from about 0.1 to 40 Anson Units per kilogram of composition of a serine proteolytic enzyme obtained from *Bacillus subtilis, Bacillus licheniformis* or mixtures thereof; and (f) from about 2% to 15% by weight of a suds booster selected from the group consisting of betaines and amine oxide semi-polar nonionic surfactants;

said composition having a pH of from about 7 to 10.

8. A composition according to claim 7 which additionally contains from about 0.5% to 1% by weight of calcium ions.

9. A composition according to claim 8 wherein said calcium and/or magnesium ions are provided at least in part by compounds selected from the group consisting of hydroxides, oxides, chlorides, formates, acetates, and mixtures of these compounds.

10. A composition according to claim 8 wherein calcium ions are provided at least in part by the hydrotrope material which is used in said composition.

11. A method for soaking hands in the context of a manual dishwashing operation, with reduced skin irritation resulting therefrom, which method comprises:

1) preparing an aqueous dishwashing solution from an effective amount of a dishwashing detergent composition according to claim 1; and 2) immersing the hands of the dishwasher in said dishwashing solution for a period of time which is effective to complete hand dishwashing operations.

12. A handsoaking method according to claim 11 wherein the dishwasher's hands are immersed in said dishwashing solution for a period of at least about 15 minutes.

13. A handsoaking method according to claim 11 where the dishwaher's hands are immersed in said dishwashing solution for a period of at least about 30 minutes.

* * * * *